US006769833B2

(12) United States Patent
Dicke et al.

(10) Patent No.: US 6,769,833 B2
(45) Date of Patent: Aug. 3, 2004

(54) PIVOTING VEHICLE BARRIER

(75) Inventors: Grant D. Dicke, Downers Grove, IL (US); James Kokenes, Westmont, IL (US)

(73) Assignee: Dicke Tool Company, Downers Grove, IL (US)

( * ) Notice: Subject to any disclaimer, the term of this patent is extended or adjusted under 35 U.S.C. 154(b) by 0 days.

(21) Appl. No.: 10/353,491

(22) Filed: Jan. 29, 2003

(65) Prior Publication Data

US 2003/0119710 A1 Jun. 26, 2003

Related U.S. Application Data

(63) Continuation-in-part of application No. 09/832,384, filed on Apr. 11, 2001, now abandoned.

(51) Int. Cl.[7] ..... E01F 15/00; G09F 15/00
(52) U.S. Cl. ..... 404/10; 40/608
(58) Field of Search ..... 404/10, 9, 6; 40/608

(56) References Cited

U.S. PATENT DOCUMENTS

| | | | | |
|---|---|---|---|---|
| 1,250,064 A | | 12/1917 | Whims | |
| 3,838,661 A | | 10/1974 | Medley, Jr. | |
| 4,270,873 A | * | 6/1981 | Laehy et al. | 404/10 |
| 4,341,488 A | | 7/1982 | Ryan | |
| 4,491,438 A | | 1/1985 | Berutti | |
| 4,806,046 A | | 2/1989 | Clark | |
| 4,839,567 A | | 6/1989 | Milton et al. | |
| 5,001,402 A | | 3/1991 | Milton et al. | |
| 5,006,009 A | | 4/1991 | Griffin | |
| D334,314 S | | 3/1993 | Milton | |
| 5,199,814 A | | 4/1993 | Clark et al. | |
| 5,207,377 A | | 5/1993 | Brecht | |
| 5,273,371 A | | 12/1993 | Hugron | |
| 5,354,144 A | | 10/1994 | Lizakowski | |
| 5,518,337 A | * | 5/1996 | Modlin | 404/10 |
| 5,597,262 A | | 1/1997 | Beavers et al. | |
| 5,738,317 A | | 4/1998 | Hugron | |
| 5,937,510 A | | 8/1999 | Seiersen | |
| 6,036,400 A | | 3/2000 | Clark | |
| 6,149,340 A | | 11/2000 | Pateman | |
| 6,217,005 B1 | | 4/2001 | Scott | |
| 6,237,268 B1 | | 5/2001 | Levin | |
| 6,264,247 B1 | | 7/2001 | Lombari et al. | |
| 6,416,248 B1 | | 7/2002 | Clark | |
| D465,170 S | | 11/2002 | Hannah | |

FOREIGN PATENT DOCUMENTS

EP 0 112804 A2 4/1984

* cited by examiner

*Primary Examiner*—Thomas B. Will
*Assistant Examiner*—Raymond W. Addie
(74) *Attorney, Agent, or Firm*—Fitch, Even, Tabin & Flannery

(57) ABSTRACT

A vehicular barrier post includes an upper tubular portion and a lower tubular stand-off. The upper portion is joined to a rocking base having a tubular bottom portion telescopically received in the stand-off. The upper end of a tension spring is secured to the upper body portion by a pin. The lower end of the spring is attached to a tension member, such as a chain, which passes through the stand-off so as to be received in a hole in a suitable external support. The chain is pulled past the external support and when the spring is appropriately tensioned, a locking pin is passed through the chain, preventing its reverse travel through the external support. The upper body portion is allowed to freely rock about the stand-off.

6 Claims, 5 Drawing Sheets

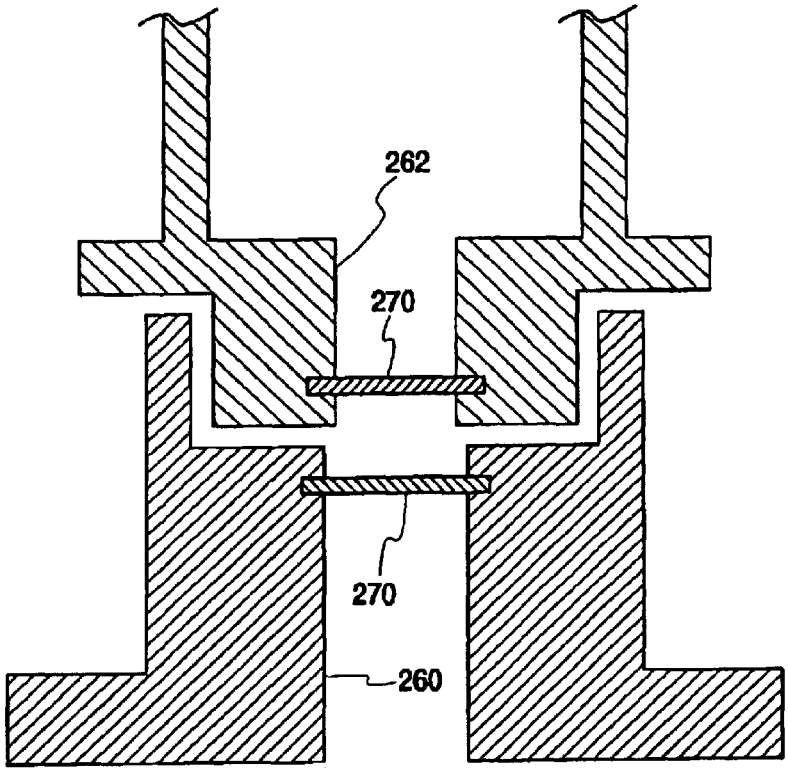
Fig. 7
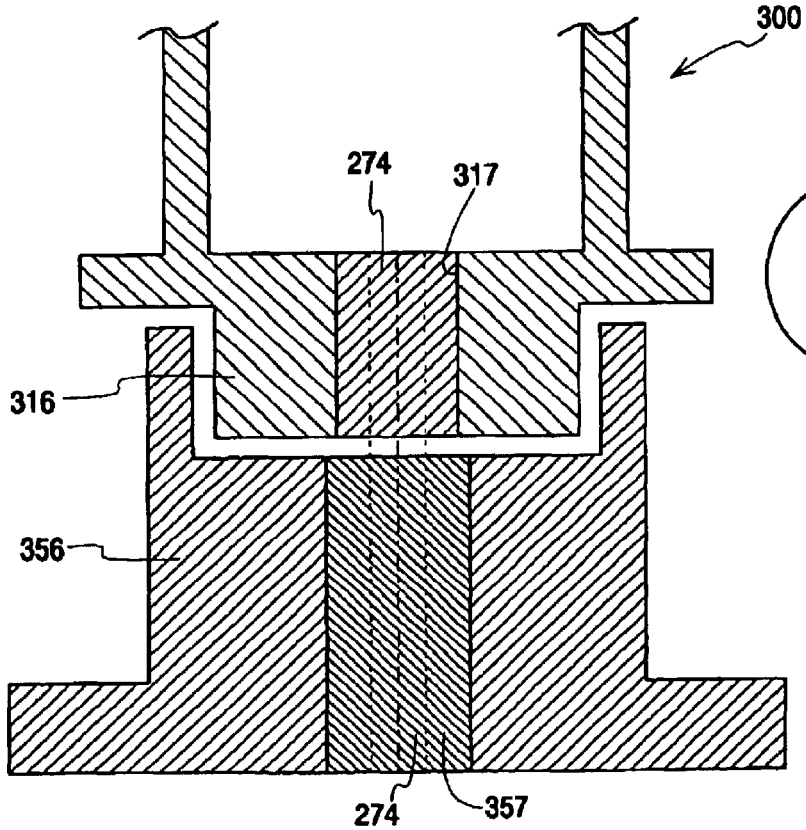
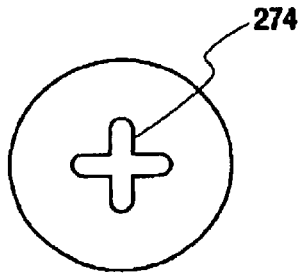
Fig. 8
Fig. 9

PIVOTING VEHICLE BARRIER

CROSS REFERENCE TO RELATED APPLICATIONS

This a continuation-in part, of prior application Ser. No. 09/832,384, filed Apr. 11, 2000 abandoned, which is hereby incorporated herein by reference in it's entirety.

BACKGROUND OF THE INVENTION

1. Field of the Invention

The present invention pertains to vehicle barriers and in particular to vehicle barrier posts.

2. Description of the Related Art

Over the years, various devices have been used to guide vehicles along a stretch of road, particularly in areas where a vehicle operator may mix—interpret the course of the roadway due, for example to an abrupt change of direction or a temporary construction work site. Devices used in the past include guard grails, barricades of various sizes to be placed on or near the roadway surface and barrels or the like devices acting as pylons. As pointed out in recent studies culminating in NCHRP 350 guidelines, attention has been focused on roadway or roadside devices which may be inadvertently struck by vehicles traversing the roadway. Such studies are especially concerned with injuries that may result when roadside devices are inadvertently struck by moving vehicles. In general, it has been found desirable to reduce the mass of roadside devices and to alter their construction where possible to reduce or eliminate immovable fixing of the roadside devices. In response to these and other similar concerns, a number of different post constructions have been proposed, which readily deflect when impacted by a moving vehicle. In general, these posts are made to have a much smaller mass than other roadside path-guiding devices, such as barrels and barricade. A number of posts are made flexible by reason of the materials (such as resilient plastic) from which the posts are made (see, for example, U.S. Pat. Nos. 4,343,567; 4,092,081; 4,084,914 and 4,123,183). In other post constructions, deflectability is provided, in general, by segmenting the post and joining the post members using spring forces, which are readily overcome upon impact. Examples of these latter constructions may be found in U.S. Pat. Nos. 4,106,878; 4,092,081; 5,199,814; and 4,806,046. Although these spring-loaded constructions are made to deflect upon impact and often provide automatic restoration when the impact force is removed (sometimes described as self-upriding) various improvements are being sought. For example, due to the construction of the spring-loaded devices, their response to an impact force may depend upon the direction at which the impact is made to the post. Accordingly, posts with directional response must be oriented with respect to the direction of oncoming traffic and some measure of uncertainty as to the response of the device when struck from a different direction, must be taken into account. Further improvements are sought in simplifying the construction of such devices, which usually leads to cost reduction.

SUMMARY OF THE INVENTION

It is an object of the present invention to provide a vehicle barrier post fur use in roadside applications as well as applications on a roadway surface.

Another object of the present invention is to provide a vehicle barrier post of the above type which presents little or no practical resistance when impacted by a moving vehicle.

A further object of the present invention is to provide a post of the above-described type which is self-restoring after the impact-force is removed.

A further object of the present invention is to provide a vehicle barrier post of the above-described type which can be economically formed from a minimum number of inexpensive parts.

These and other objects of the present invention are provided in a deflectable sign mounting, comprising:

a tubular body, having upper and lower ends, for supporting the sign;

an extension spring secured within the tubular body;

a rocking base at the lower end of the tubular body;

said tubular body, said extension spring and said rocking base together comprising an upper assembly;

a stand-off member defining a hollow cavity and having upper and lower ends, the upper end of the standoff adapted for rocking engagement with the rocking base;

an elongated tether member having a second end secured to said deflectable sign mounting and a first end engaging said extension spring so as to hold said extension spring in tension;

a device base supporting said extension spring in an extended position, the device base defining an interior opening receiving the second end of the said elongated tether member;

a retainer member engaging the second end of said tether member so as to support the second end of the device base to maintain a predetermined tension in said extension spring; and the rocking base and the upper end of the stand-off cooperating such that the upper assembly rocks about the stand-off upon application of a lateral force to the tubular body at a rest position, causing a bias energy to be stored within said extension spring, biasing the rocking base toward its rest position upon removal of the dislodging force.

BRIEF DESCRIPTION OF THE DRAWINGS

FIG. 7 shows a fragment of FIG. 6 taken on an enlarged scale;

FIG. 8 is a cross-sectional pattern; and

FIG. 9 is a fragmentary view of another mounting arrangement according to principles of the present invention.

DETAILED DESCRIPTION OF THE PREFERRED EMBODIMENTS

Figure 1:
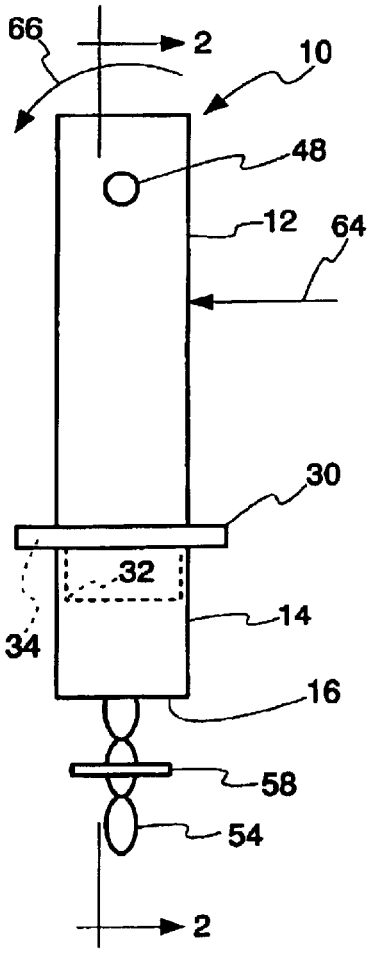
FIG. 1 is an elevational view of a vehicular barrier post according to principles of the present invention.
Figure 4:
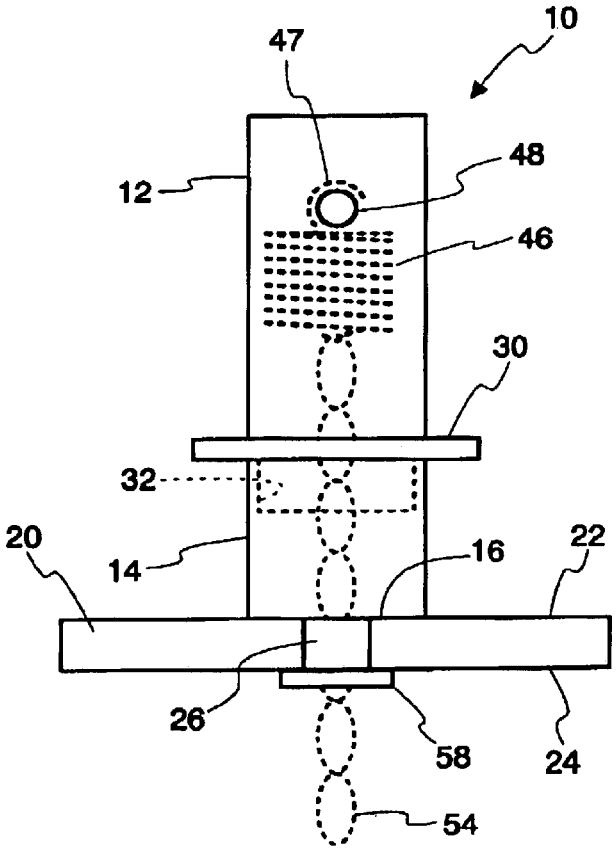
FIG. 4 is elevational view similar to that of FIG. 1 but showing internal components in phantom.
Figure 3:
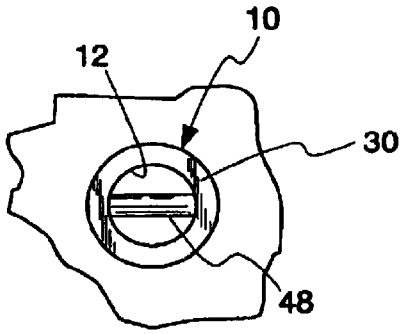
FIG. 3 is a top plan view thereof.
Figure 2:
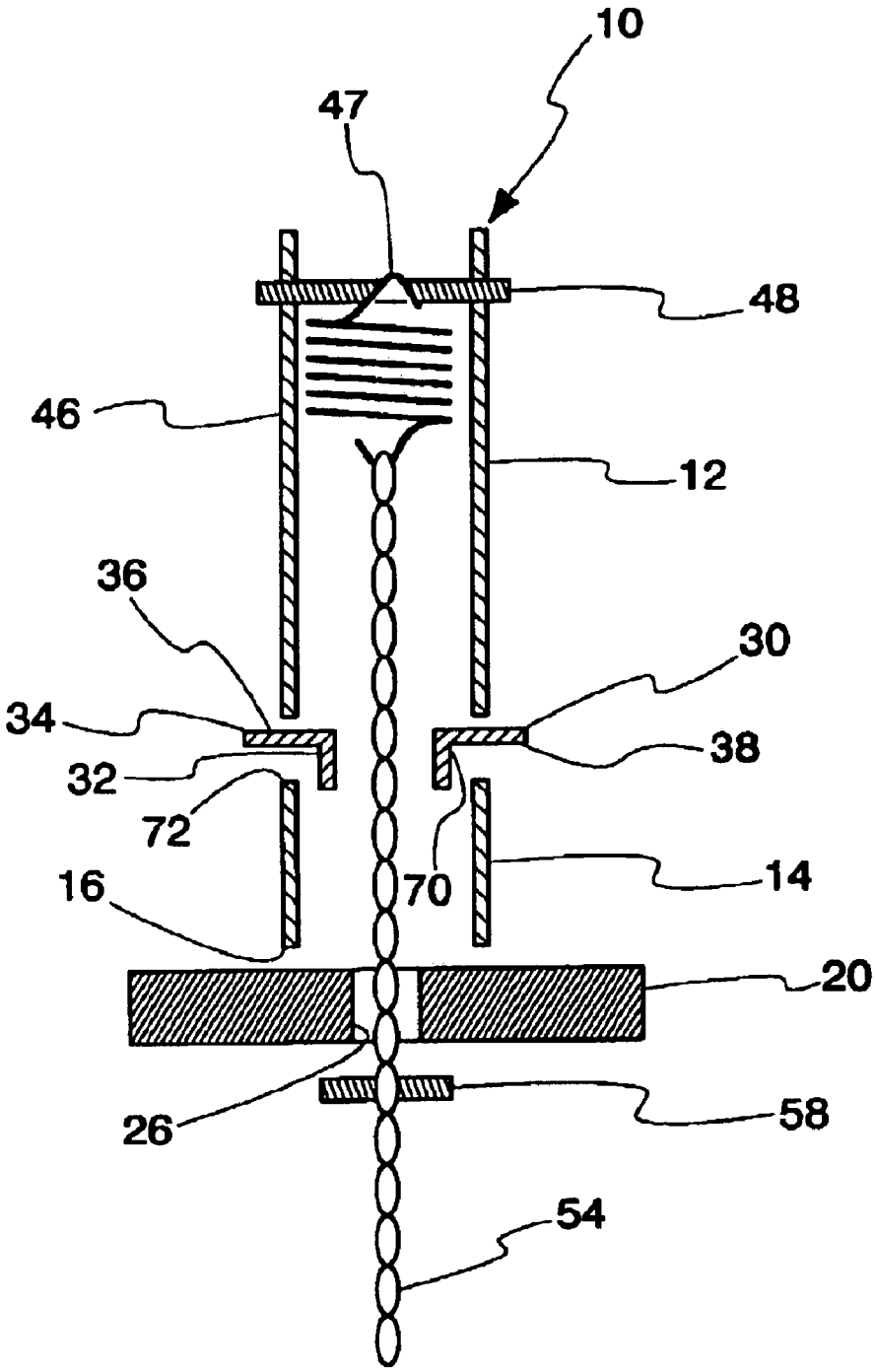
FIG. 2 is a rear cross-sectional view taken along the line 2—2 of FIG. 1.

Referring now to the drawings, and initially to FIGS. 1–4, a mounting arrangement or vehicular barrier post constructed according to principles of the present invention is general indicated at 10. Included are an upper body portion in the form of a hollow cylindrical tube 12 and a bottom body portion or tubular stand-off 14. As indicated in FIG. 4, the bottom end 16 of stand-off 14 rests against an external support 20 having an upper surface 22, and an opposed lower surface 24 and a hole or passageway 26. Disposed between upper body portion 12 and stand-off 14 is a rocking base 30, shown in cross-section in FIG. 2. The rocking base preferably comprises a first cylindrical portion 32 joined at its upper end to a circular disk 34 having an upper surface 36 and an opposed lower surface 38. As indicated in FIGS. 1 and 4, the base portion 32 is dimensioned for telescopic insertion within the inner bore of stand-off 14. The circular disk portion 34 of rocking base 30 has cross-sectional size greater than that of upper body portion 12 and stand-off 14. When assembled in the manner shown in the figures, the disk portion 34 of rocking base 30 protrudes laterally beyond the sides of upper body portion 12, disposed there above and stand-off 14 disposed there below. A coiled extension spring 46 is disposed within the inner bore of upper body portion 12 and is secured at its upper end 47 by a pin 48 which extends through upper body portion 12 (see FIG. 2). The lower end of spring 46 is secured to a flexible tension member 54, preferably in the form of a chain. With reference to FIG. 4, the tension member 54 extends through rocking base 30 and stand-off 14 as well as passageway 26 formed in the external support 20. The flexible tension member 54 is then pulled to store energy in spring 46, with retraction of the spring being perverted by a locking pin 58 bearing against the underneath surface 24 of external support 20. As a result, the body portions 12, 14 and 30 of post 10 are joined together to assume the upright position shown, for example, in FIGS. 1 and 4. If desired, the flexible tension member 54 could take the form of a wire cable or a spring rod. Non-metallic tension members, such as a fiberglass rod, may also be used, if desired.

When impacted by a force in the direction of arrow 64, shown in FIG. 1, upper body portion 12 is inclined, or rotated in the direction of arrow 66, with the upper end of body portion 12 moving to the left. This applies a downward force to the left end of disk portion 34 which, initially, is free to follow movement of upper body portion 12. Eventually, with sufficient inclination, tube portion 32 of the rocking base 30 contacts the inner wall of stand-off 14 thereby limiting further inclination of disk portion 30 depending upon the relative clearance between tube portion 32 and the inner bore of stand-off 14. In the preferred embodiment, stand-off 14 is not affixed to the external support 20 and is free to move under the applied displacement force. However, it is generally preferred that the spring of 46 be constructed so as to yield before stand-off 14 is made to undergo substantial deflection. In its preferred operation, further bending of post 10 occurs between upper body portion 12 and rocking base 30. In the preferred embodiment, spring 46 and the construction of tension member 54 cooperates so as to allow upper body portion 12 to undergo substantial deflection, to the point where upper body portion 12 is allowed to bend in a generally horizontal direction. Spring 46 is constructed so as to readily extend a length sufficient to allow upper body portion 12 to assume a horizontal direction. The tension member 54 is constructed so as to slide over any portions it may contact as the upper body portion 12 is allowed to "pull away" from its rest position, shown in the figures. When the distorting force indicated by arrow 64 is removed, spring 46 is allowed to resume to a position minimizing stored energy, causing tension member 54 to pull against locking pin 58, as the upper body portion assumes an upright position.

In the preferred embodiment, the upper body portion is affixed to rocking base 30 to form an integral assembly therewith. The tubular portion 32 of rocking base 30 is dimensioned so as to be freely movable within the inner bore of stand-off 14 allowing freedom of movement, throughout the full range of motion of upper body portion 12, i.e., between the upright position as shown in the figures and an horizontally directed position, generally assumed to be full deflection. It is possible that the upper body portion 12 could undergo a further displacement, forming an acute angle with the vertical line of stand-off 14.

As mentioned above, the bottom end 16 of stand-off 14 is held against the upper surface of external support 20. Due to the flexible mounting of upper body portion 12, stand-off 14 could be affixed to prevent motion relative to external support. However, it is also possible to assembly post 10 with affixing the stand-off to external support 20, especially if the spring 46 is constructed so as to allow ready expansion so as to allow most of the deflection of post 10 to occur at rocking base 30, without substantial deflection of stand-off 14 relative to external support 20.

During deflection of upper body portion 12, the corner 70 formed by the tubular portion 32 and disk portion 34 of rocking base 30 rides or pivots over the upper end 72 of stand-off 14. Preferably, upper end 72 is rounded for smooth operation. If desired, the corner 70 of rocking base 30 can be filled in or rounded to assume a convex shape to more smoothly travel over the upper end 72. As will be appreciated, the rocking movement of upper body portion 12 is made directionally independent. Further, pieces interfitting with a close tolerance fit are eliminated by the design of the present invention, thereby avoiding the negative effects associated with roadside operation, such as elevated corrosion rates associated with ocean environments and ice melting products. As will now be appreciated, the major body components of post 10, namely the upper portion 12, rocking base 30 and stand-off 14 can be made of plastic materials, further enhancing corrosion resistance. Of course, if desired, one or more of these components could be made from metal, or metal alloys.

As mentioned, it is generally preferred that upper body portion 12 be joined to rocking base 30 to form an integral assembly, with the tubular portion 32 of the rocking base being permitted freedom of full travel within the inner bore of stand-off 14. Although conventional limit stops could be added to either the rocking base 30, or the stand-off 14, or both, this would hinder the ready deflection of post 10, when employed as a vehicular barrier device. In a different application, the upper body portion 12 can be extended so as to receive an upright sign support, and rotation limiting of a rocking base 30 may become desirable so as to limit the amount of inclination of the sign panel supported by post 10. It is generally preferred that such sign supporting uses of post 10 be employed at locations where vehicle impact is unlikely.

Reference has been made above to external support 20. As contemplated by the present invention, external support can comprise any number of conventional arrangements, such a planking installed on a roadway surface, or a base, such as that shown in U.S. Pat. No. 5,199,814 or U.S. Design Pat. No. 334,314. Alternatively, external support 20 could comprise a short section of construction material, dimensioned larger than the cross-section of stand-off 14. After adjusting the tension of spring 46, the external support 20 and possible the lower portion of stand-off 14 could be cast in roadway material filling a roadway depression. It should be noted in this regard, that the present invention would still allow ready replacement of internal components within post 10. For example, a tripod or other device could be assembled above post 10 to support the upper end of spring 47, allowing the extraction pin 48, thereby allowing replacement of spring 46 or the replacement of upper body portion 12 with a body portion of different length.

Figure 5:
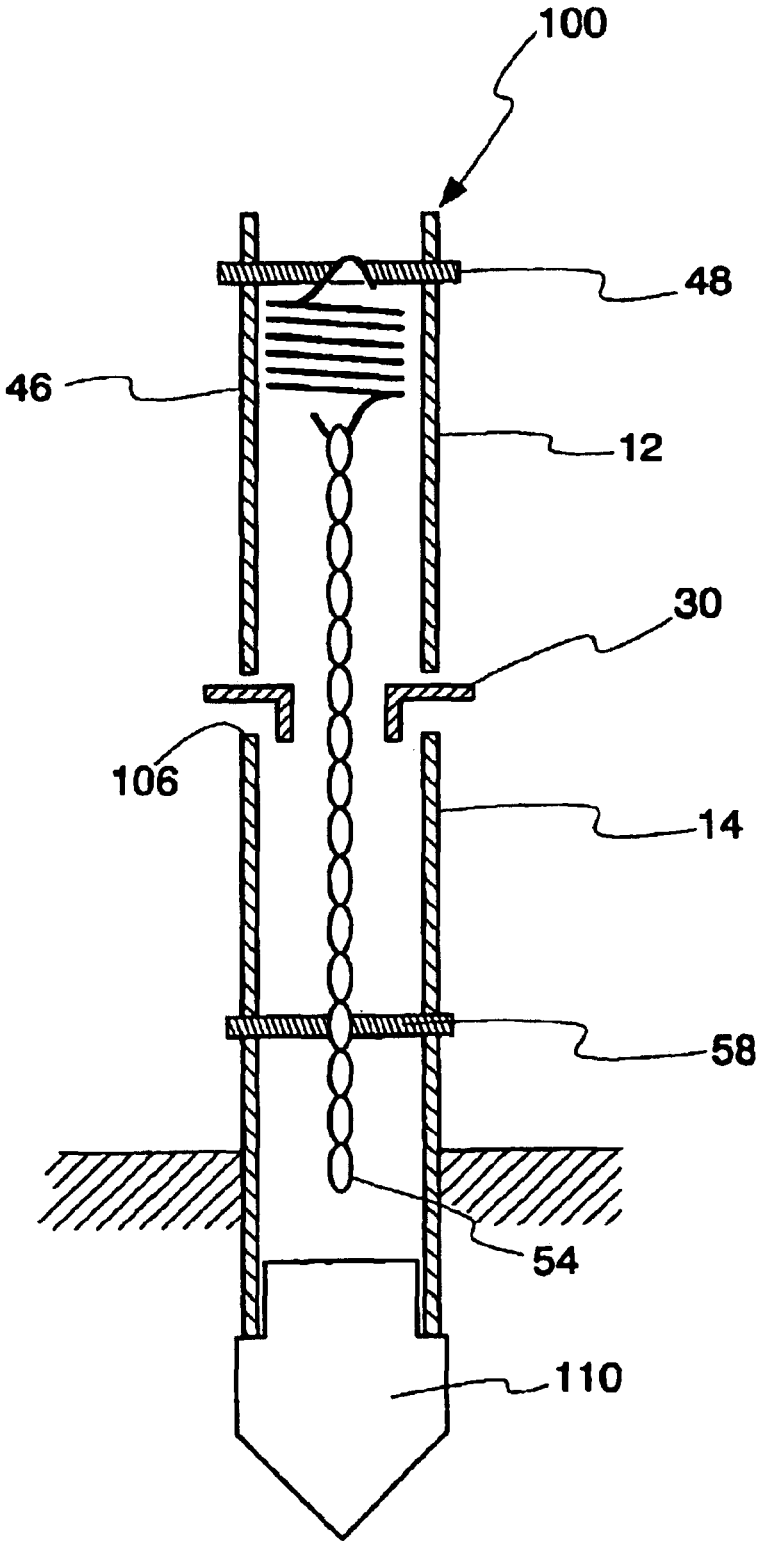
FIG. 5 is an exploded cross-sectional view of the vehicular barrier post with an alternative mounting arrangement.

Turning now to FIG. 5, an alternative embodiment generally indicated at 100 is shown. As can be seen with comparison to the preceding figures, post 100 generally resembles the construction described above for post 10. In the arrangement of post 100 illustrated in FIG. 5, the stand-off described above is replaced with a second body portion 104 having an upper end 106 functioning in a manner similar to the upper end 72 of stand-off 14, described above. A ground penetrating tip 110 is provided at the lower end of body portion 104 and, as indicated in FIG. 5, is located below grade. If desired, body portion 14 could be pounded or turned into the ground, with the remaining components thereafter being assembled in the manner illustrated. Alternatively, a hole similar to that required for a fence post could be provided for ready installation of body portion 104. The hole could be filled with concrete, asphalt or other fixing medium. Alternatively, a ground socket having an inner bore dimensioned to receive the lower end of body portion 104 could also be provided. If desired, the post 100 could be fully assembled before insertion of body portion 105 into the roadway surface or ground. Alternatively, the flexible tension member 54 could be pinned at 58 to body portion 104 with the spring 46 being pulled from above to allow insertion of pin 48 holding the spring 46 captive against downward displacement. The upper end of spring 46 could, for example, be provided with a pull ring for this purpose.

Figure 6:
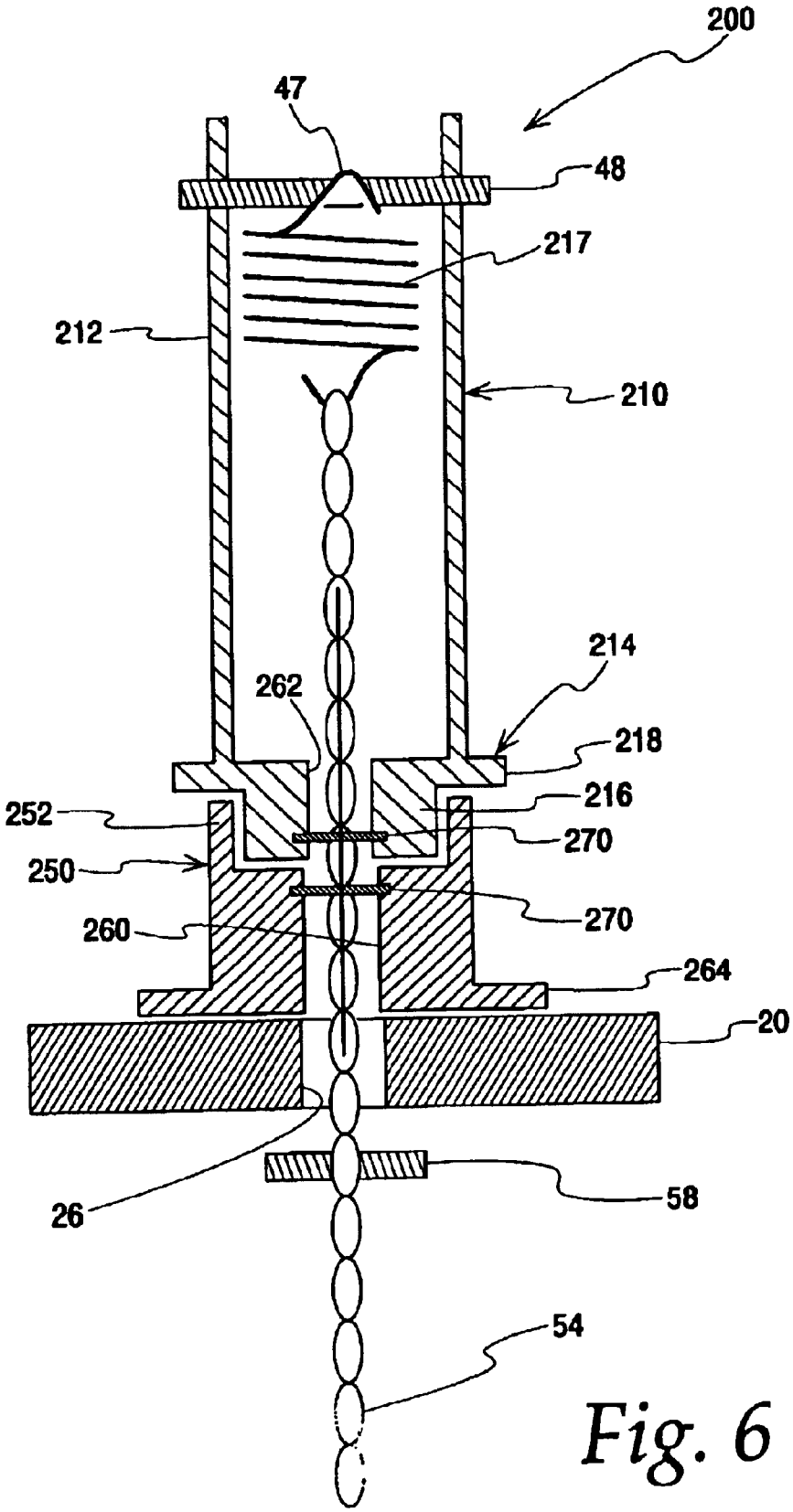
FIG. 6 is a cross-sectional view of an alternative mounting arrangement according to principles of the present invention.

Turning now to FIGS. 6–9, further embodiments according to principles of the present invention are shown. FIG. 6 shows a mounting arrangement 200 which contains several features of the mounting arrangement or post 10 described above. Included is a unitary upper body portion 210 and a unitary lower body portion 250 coupled together in a rocking engagement. In FIGS. 6 and 7, a small gap is shown between the upper and lower body portions 210, 250 for illustrative purposes only. When fully assembled, the upper and lower body portions are pressed into engagement with one another.

Unitary upper body portion 210 includes a cylindrical tube portion 212 and a lower base portion 214. Unlike the mounting arrangement of post 10, cylindrical portion 212 and lower base portion 214 together comprise a unitary construction. A spring 217 and a chain 54 are enclosed within cylindrical tube portion 212, with the upper end of spring 217 being secured by pin 48.

Lower base portion 214 includes a cylindrical part 216 integrally formed with a circular disc part 218. Together, the cylindrical part 216 and circular disc part 218 formed a stepped outer surface which nests within the stepped inner surface of unitary lower body portion 250. Included in unitary lower body portion 250 is a stepped upper end 252 and a stand off body part 256 defining an inner bore 260 through which chain 54 passes. Unitary lower body portion 250 is secured to an external support such as support 20. An optional flange 264 is provided at the bottom end of unitary lower body portion 250 for joinder to support 20. If desired, unitary lower body portion 250 and support 20 can be formed as a monolithic part.

As shown in FIGS. 6 and 7, cylindrical part 216 and stand off body part 256 define internal passageways 262, 260, respectively which together form a continuous passageway through the lower end of a mounting arrangement. Alignment members 270 have a shape corresponding to the pattern of FIG. 8 and define a cross-shaped internal opening 274 which receives chain 54 controlling the rotation orientation of chain 54 as it passes through the alignment members 270.

Referring to FIG. 9, an alternative mounting arrangement 300 generally resembles mounting arrangement 200 as can be seen by comparison to the fragmentary cross-sectional view of FIG. 7. However, unlike mounting arrangement 200, the center of stand off body part 356 and the center of cylindrical part 316 include solid portions 317, 357 which have a cross-sectional shape corresponding to the pattern of FIG. 8, forming a continuous cross-shaped central passage way 274 which preserves a desired rotational alignment of the chain passing through that part of the mounting arrangement 300 shown in FIG. 9. Central portions can be formed separately, or can be integral with the body part and the cylindrical, if desired.

The gap shown in FIG. 9, between the upper and lower body portions is introduced for graphical clarity. When the mounting arrangement 300 is fully assembled, the upper and lower body portions are pressed into engagement with one another.

Thus, it can be seen that vehicular barrier posts according to principles of the present invention can be provided for a variety of installations, both permanent and temporary. With the present invention, the vehicular barrier post can be modified for replacement of internal components or to alter the height or style of the upper portion of the post. As a further advantage, the present invention allows substantial reduction in mass of the vehicular barrier post. As can be seen from the above, major body portions of vehicular barrier posts according to principles of the present invention are hollow and can be formed from lightweight construction materials, such as plastic pipe or tubing. Further, with the present invention stability during deflection is improved. As mentioned above, the corner of the rocking base pivots around the upper end of tubular stand-off. The corner of the rocking base provides substantial capture of the upper end of the stand-off 14, representing an enhancement over previous constructions which required an end-to-end engagement of similarly dimensioned components.

If desired, spring tensions can be adjusted in small increments in a number of ways. For example, with reference to FIG. 4, when a chain is employed as the tension member, the number of lengths of chain protruding from bottom surface 24 can be counted to provide a ready indication of corresponding energy stored in spring 46. Alternatively, if the length of the tension member is to remain constant, a series of holes can be formed in upper body portion 12 extending along its length. With the pin 48 received in a lower hole, for example, spring 46, held captive by pin 48, will store less tension than when the spring is held captive at a higher position hole. Such arrangements may be particularly advantageous when extension members other than chains are employed.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A deflectable sign mounting, comprising upper and lower body portions:

a tube portion, having an outer surface and upper and lower ends, for supporting the sign;

an extension spring secured within the tube portion;

a rocking base at the lower end of the tube portion;

said tube portion, said extension spring and said rocking base together comprising an upper assembly with said tube portion and said rocking base comprising a unitary one-piece upper body portion;

a stand-off member having an upper end which is hollow and cylindrical and which has an outer surface;

the rocking base including a cylindrical part received in the upper end of the stand-off member and a circular disc extending outwardly from the cylindrical part so as to contact said stand off member, extending outwardly beyond the outer surfaces of said tube portion and said stand off member;

a tether member engaging said extension spring, supporting said extension spring in an extended position;

the rocking base and the upper end of the stand-off member cooperating such that the upper assembly rocks about the stand-off member upon application of a lateral force to the tube portion, causing a bias energy to be stored within said extension spring, biasing the rocking base toward its rest position upon removal of the dislodging force; and said stand off member and said rocking base each defining a central cross-shaped opening forming a passageway for receiving said tether member, confining said tether member so as to preserve the angular position of the tether member.

2. The deflectable sign mounting according to claim 1 wherein said tether member has a second end coupled to said standoff member and a first end engaging said extension spring so as to hold said extension spring in tension.

3. The deflectable sign mounting according to claim 1 wherein said tether member comprises a chain.

4. The deflectable sign mounting according to claim 1 further comprising a retainer member cooperating with the tether member to hold the tether member and spring in an extended, pre-tensioned configuration.

5. The deflectable sign mounting according to claim 4 wherein said retainer member comprises a pin.

6. The deflectable sign mounting according to claim 1 wherein said stand-off member comprises a cylindrical standoff body part. exit

* * * * *

UNITED STATES PATENT AND TRADEMARK OFFICE

CERTIFICATE OF CORRECTION

PATENT NO. : 6,769,833 B2
DATED : August 3, 2004
INVENTOR(S) : Dicke et al.

It is certified that error appears in the above-identified patent and that said Letters Patent is hereby corrected as shown below:

Column 8,
Line 26, delete “exit” after the period

Signed and Sealed this

First Day of February, 2005

JON W. DUDAS
*Director of the United States Patent and Trademark Office*